US008813998B2

(12) United States Patent
Sartini et al.

(10) Patent No.: US 8,813,998 B2
(45) Date of Patent: Aug. 26, 2014

(54) DISPENSERS FOR SANITARY TISSUE PRODUCTS

(75) Inventors: Emma Lynn Sartini, Cincinnati, OH (US); Kyoko Mignot, West Chester, NY (US); Michael Sean Farrell, Terrace Park, OH (US); Nicholas August Vitucci, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 255 days.

(21) Appl. No.: 13/455,523

(22) Filed: Apr. 25, 2012

(65) Prior Publication Data

US 2012/0273514 A1 Nov. 1, 2012

Related U.S. Application Data

(60) Provisional application No. 61/517,963, filed on Apr. 28, 2011.

(51) Int. Cl.

| | |
|---|---|
| ***A47K 10/24*** | (2006.01) |
| ***A47K 10/42*** | (2006.01) |
| ***A47K 10/32*** | (2006.01) |

(52) U.S. Cl.

CPC ..... *A47K 10/32* (2013.01); *A47K 10/42* (2013.01)

USPC ..... 221/45; 221/63

(58) Field of Classification Search

CPC ..... A47K 10/18; A47K 10/185; A47K 10/20; A47K 10/42; A47K 10/424; A47K 10/421; A47K 10/32; B65D 83/0805; B65D 5/4208

USPC ..... 221/45, 283, 63; 206/494, 806, 233

See application file for complete search history.

(56) References Cited

U.S. PATENT DOCUMENTS

| | | | | |
|---|---|---|---|---|
| 497,005 | A | 5/1893 | Jerome | |
| 3,035,803 | A * | 5/1962 | Miller | 248/313 |
| 4,369,929 | A | 1/1983 | Cayer | |
| 4,828,193 | A | 5/1989 | Galbraith | |
| 5,170,956 | A | 12/1992 | McTaggart | |
| 5,613,608 | A * | 3/1997 | Tronchetti et al. | 206/494 |

(Continued)

FOREIGN PATENT DOCUMENTS

| | | |
|---|---|---|
| EP | 2 425 756 | 3/2012 |
| WO | WO 2004/084694 | 10/2004 |
| WO | WO 2011/072757 | 6/2011 |

OTHER PUBLICATIONS

U.S. Appl. No. 13/449,844, filed Apr. 18, 2012, Hutchison, et al.

(Continued)

*Primary Examiner* — Timothy Waggoner

(74) *Attorney, Agent, or Firm* — Roddy Bullock; Christian Best

(57) ABSTRACT

A dispenser for sanitary tissue products is provided. The dispenser comprises a housing defining a cavity configured to receive sanitary tissue products therein and an opening defined in the housing. The sanitary tissue products within the cavity are configured to be dispensed through the opening. The opening is defined by a first portion having a first width, a second portion having a second width, and a third portion having a third width. The third portion extends between the first portion and the second portion. The first width and the second width are both larger than the third width.

7 Claims, 22 Drawing Sheets

(56) References Cited

U.S. PATENT DOCUMENTS

| | | | | |
|---|---|---|---|---|
| 5,763,984 | A | 6/1998 | Day | |
| 6,161,796 | A | 12/2000 | Daniels | |
| 6,302,348 | B1 | 10/2001 | Lillelund et al. | |
| D450,961 | S | 11/2001 | Loud | |
| 6,585,130 | B2 * | 7/2003 | Turbett et al. | 221/45 |
| 6,641,100 | B2 * | 11/2003 | Furukawa | 248/309.1 |
| 6,786,377 | B1 | 9/2004 | Holden | |
| 6,929,148 | B2 * | 8/2005 | Haddad et al. | 221/45 |
| 6,929,213 | B1 | 8/2005 | Contreras | |
| 7,090,106 | B2 | 8/2006 | Holden | |
| 7,124,976 | B1 | 10/2006 | DeVincenzo | |
| 7,140,573 | B1 | 11/2006 | Jerstroem et al. | |
| 7,264,197 | B2 | 9/2007 | Yu | |
| 7,401,749 | B2 | 7/2008 | Yang et al. | |
| 7,694,848 | B2 * | 4/2010 | Petry | 221/45 |
| 7,726,513 | B2 * | 6/2010 | Schlaupitz et al. | 221/45 |
| 2002/0033406 | A1 | 3/2002 | Holden | |
| 2003/0136793 | A1 * | 7/2003 | Chen | 221/63 |
| 2004/0084469 | A1 | 5/2004 | Tu | |
| 2005/0247817 | A1 | 11/2005 | Holden | |
| 2006/0071119 | A1 | 4/2006 | Zeitlin | |

OTHER PUBLICATIONS

U.S. Appl. No. 13/453,050, filed Apr. 23, 2012, Redd, et al.
U.S. Appl. No. 13/455,510, filed Apr. 25, 2012, Stephens, et al.

* cited by examiner

DISPENSERS FOR SANITARY TISSUE PRODUCTS

CROSS REFERENCE TO RELATED APPLICATION

This application claims the benefit of U.S. Provisional Application No. 61/517,963 filed on Apr. 28, 2011, the entire disclosure of which is fully incorporated by reference herein.

FIELD

The present disclosure generally relates to dispensers and, more particularly, relates to dispensers for sanitary tissue products.

BACKGROUND

Sanitary tissue products in the form of paper towels, shop towels, toilet tissue, facial tissue, wet or dry wipes, and table napkins, for example, find great utility among users who value affordability, ease of use, and disposability. Sanitary tissue products are used in virtually every household, including in kitchens, bathrooms, dining rooms, and garages, for example. Sanitary tissue products, such as rolls of paper towels or hand towels, for example, are often dispensed from sanitary tissue product holders, from which they may be unrolled one or more sheets at a time. These sanitary tissue product holders may have two projections, wherein each end of a core of a roll of a sanitary tissue product may engage a projection to rotatably retain the sanitary tissue product thereto. To tear off a sheet, a user would generally inhibit the roll from rotating with one hand and tear the sheet off of the roll at a perforation with the other hand (i.e., two hand dispensing). Such sanitary tissue product holders are generally not located in bathrooms for aesthetic or other reasons. Sanitary tissue products, such as paper towels or hand towels, however, have great utility in bathrooms for many purposes, such as hand drying, makeup removal, and/or cleaning, for example. In view of the utility that sanitary tissue products may provide in a bathroom setting or in other settings, dispensers should be provided that are more aesthetically pleasing and more functional than current sanitary tissue product holders. Furthermore, dispensers that may provide one hand dispensing are desirable.

SUMMARY

In one embodiment, the present disclosure is directed, in part, to a dispenser for sanitary tissue products. The dispenser comprises a housing defining a cavity configured to receive sanitary tissue products therein and an opening defined in the housing. The sanitary tissue products positioned within the cavity are configured to be dispensed through the opening. The opening is defined by a first portion having a first width, a second portion having a second width, and a third portion having a third width. The third portion extends between the first portion and the second portion. The first width and the second width are both larger than the third width.

In another embodiment, the present disclosure is directed, in part, to a dispensing kit for sanitary tissue products. The dispensing kit comprises a dispenser defining a cavity therein. The cavity is configured to receive sanitary tissue products therein. The dispenser comprises an opening defined therein. The sanitary tissue products positioned within the cavity are configured to be dispensed through the opening. The opening is formed by a first portion having a first width, a second portion having a second width, and a third portion having a third width. The third portion extends between the first portion and the second portion. The first width and the second width are both larger than the third width. The dispensing kit further comprises a hanger configured to releasably attach to the dispenser. The hanger comprises a first end portion comprising a base configured to engage a surface, a second end portion comprising one or more hooks configured to engage a towel bar or a towel ring, and a body disposed intermediate the base and the one or more hooks.

In still another embodiment, the present disclosure is directed, in part, to a hanger for a sanitary tissue product dispenser having two or more apertures defined therein. The hanger comprises a first end portion comprising a generally flat base configured to engage a surface, a second end portion comprising one or more hooks configured to engage a towel bar or a towel ring, and a body disposed intermediate the base and the one or more hooks. The body comprises a first portion and a second portion. The first portion comprises a first engagement member and a second engagement member both extending therefrom. The first engagement member is configured to engage perimeter walls of a first aperture in the dispenser and the second engagement member is configured to engage a second aperture in the dispenser such that the hanger is removably attached to the dispenser.

BRIEF DESCRIPTION OF THE DRAWINGS

The above-mentioned and other features and advantages of the present disclosure, and the manner of attaining them, will become more apparent and the disclosure itself will be better understood by reference to the following description of non-limiting embodiments of the disclosure taken in conjunction with the accompanying drawings, wherein.

DETAILED DESCRIPTION

Figure 1:
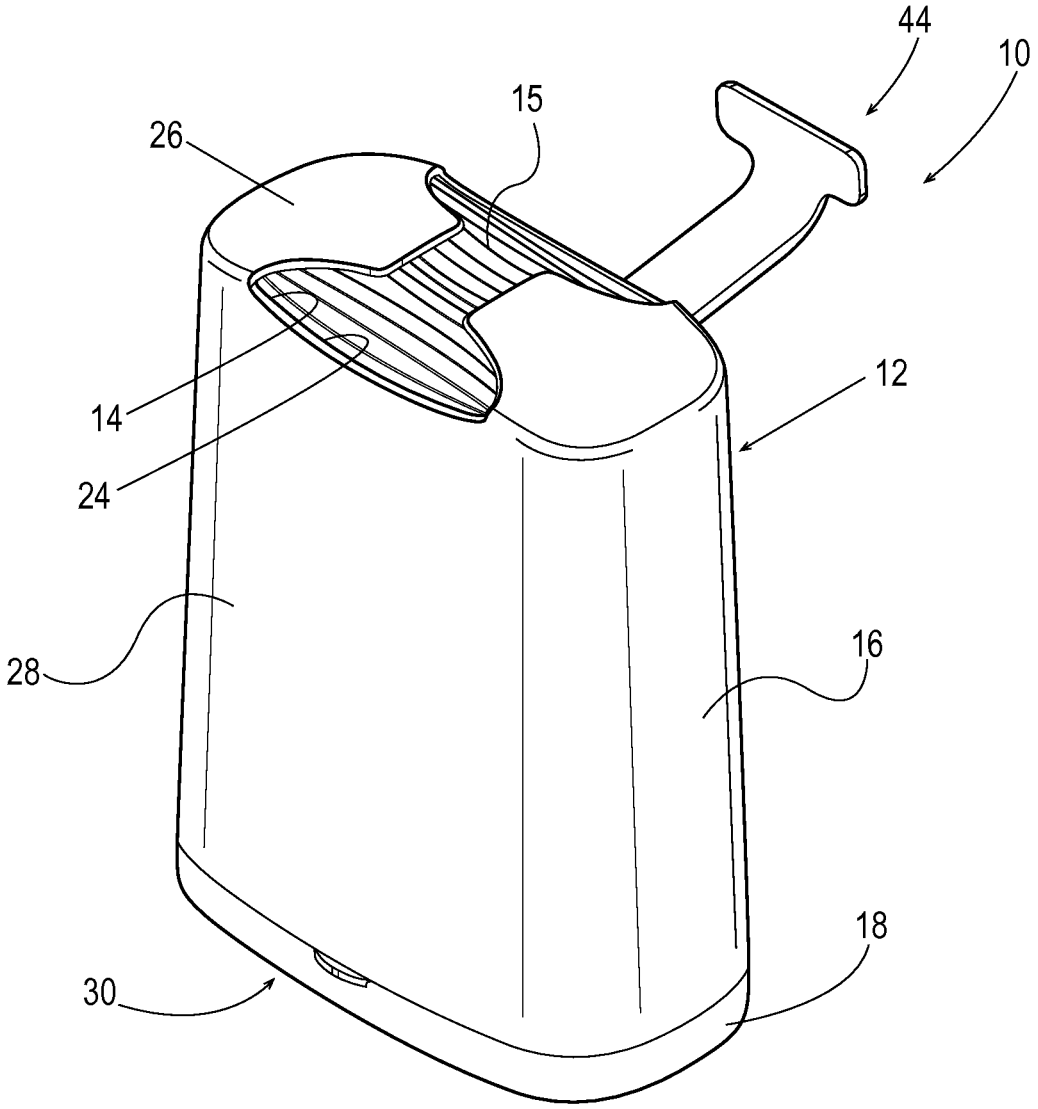
FIG. 1 is a front perspective view of a dispenser for one or more sanitary tissue products attached to a hanger in accordance with one non-limiting embodiment.

Various non-limiting embodiments of the present disclosure will now be described to provide an overall understanding of the principles of the structure, function, manufacture, and use of the dispensers for sanitary tissue products disclosed herein. One or more examples of these non-limiting embodiments are illustrated in the accompanying drawings. Those of ordinary skill in the art will understand that the dispensers for sanitary tissue products specifically described herein and illustrated in the accompanying drawings are non-limiting example embodiments and that the scope of the various non-limiting embodiments of the present disclosure are defined solely by the claims. The features illustrated or described in connection with one non-limiting embodiment may be combined with the features of other non-limiting embodiments. Such modifications and variations are intended to be included within the scope of the present disclosure.

"Fiber" as used herein means an elongate physical structure having an apparent length greatly exceeding its apparent diameter, i.e., a length to diameter ratio of at least about 10. Fibers having a non-circular cross-section and/or tubular shape are common. The "diameter" in this case may be considered to be the diameter of a circle having a cross-sectional area equal to the cross-sectional area of the fiber. More specifically, as used herein, "fiber" refers to fibrous structure-making fibers. The present disclosure contemplates the use of a variety of fibrous structure-making fibers, such as, for example, natural fibers, synthetic fibers, other suitable fibers, or any combination thereof.

"Fibrous structure" as used herein means a structure that comprises one or more fibers. Nonlimiting examples of processes for making fibrous structures include known wet-laid papermaking processes and air-laid papermaking processes. Such processes typically include steps of preparing a fiber composition in the form of a suspension in a medium, either wet, more specifically aqueous medium, or dry, more specifically gaseous, i.e., with air as the medium. The aqueous medium used for wet-laid processes is oftentimes referred to as a fiber slurry. The fibrous suspension is then used to deposit a plurality of fibers onto a forming wire or belt such that an embryonic fibrous structure is formed, after which drying and/or bonding the fibers together results in a fibrous structure. Further processing the fibrous structure may be carried out such that a finished fibrous structure is formed. For example, in typical papermaking processes, the finished fibrous structure is the fibrous structure that is wound on the reel at the end of papermaking, and may subsequently be converted into a finished product, e.g., a sanitary tissue product.

"Sanitary tissue product" as used herein means one or more finished fibrous structures, converted or not, that is useful as a wiping implement for post-urinary and post-bowel movement to cleaning (e.g., toilet tissue and wet or dry wipes), for otorhinolaryngological discharges (e.g., facial tissue and wet or dry wipes), and multi-functional absorbent and cleaning uses (e.g., paper towels, shop towels, and hand towels). The sanitary tissue products may be embossed or not embossed, creped or uncreped, and may be single-ply or multi-ply.

The various dispensers of the present disclosure may be configured to dispense sanitary tissue products, such as paper towels, shop towels, and/or hand towels, for example. The sanitary tissue products may have a multitude of functions, such as cleaning or wiping body surfaces, cleaning generally, medical usage, receiving bodily discharges, hand drying, face drying, and/or makeup removal, for example. Such sanitary tissue products may be provided within cavities of the dispensers and/or within refills that are configured to be positioned within the cavities. The sanitary tissue products may be provided in stacks (e.g., horizontal or vertical stacks), sheets, folded sheets, interleaved sheets, non-interleaved sheets, C-folded sheets, Z-folded sheets, semi-folded sheets, rolls, or in any other suitable configuration for a particular use. The dispensers may be configured to dispense one or more sanitary tissue products at a time. In one embodiment, the dispensers may be configured for one hand dispensing of one or more sanitary tissue products or may be configured for two hand dispensing of one or more sanitary tissue products.

In various embodiments, portions of the dispensers that abut, are positioned against, and/or rest on a surface, such as a countertop or the top of a toilet, for example, may comprise suction cups, hook and/or loop fasteners, hook and hook fasteners, magnets, other suitable fasteners, adhesives, and/or high coefficient of friction materials (e.g., rubber), for example. Such features may at least inhibit the dispensers from moving or sliding during dispensing of one or more sanitary tissue products. In one embodiment, a complimentary fastener, such as an opposite pole magnet to a magnet on the dispenser may be attached to the surface on which the dispenser will be positioned, for example. In still other embodiments, the dispensers may be weighted or may have sufficient weight to prevent, or at least inhibit, movement or sliding during dispensing. The dispensers may be used with or without a hanger (see e.g., FIGS. 1A-1C). In one embodiment, a dispenser may be attached to, removably attached to, or formed with a hanger. The hanger may function to hang the dispenser from towel bars, towel racks, towel rings, shower curtain rods, toilet tissue holders, doors, and/or other surfaces or members. The hanger may be attached to the dispenser or side walls thereof using hook and loop fasteners, hook and hook fasteners, releasable adhesives, engagement members on the hanger and apertures in the dispensers, engagement members on the dispensers and apertures on the hanger, and/or any other suitable methods of removable or non-removable attachment. In one embodiment, the dispensers may have portions that define one or more apertures therethrough. Fasteners, such as nails or screws, may be positioned at least partially through the apertures to retain the dispensers to various surfaces, such as walls, for example. In such an embodiment, a hanger may not be required.

In one embodiment, referring to FIGS. 1, 2, and 5-10, dispensers 10 for sanitary tissue products are provided by the present disclosure. The dispensers 10 may have any suitable shape, such as the non-limiting shape illustrated in the figures. The dispenser 10 may comprise a housing 12 defining a cavity 14 therein. The cavity 14 may be configured to receive a plurality of sanitary tissue products 15. The sanitary tissue products 15 may be situated within the cavity 14 in a vertical orientation as illustrated in FIG. 1. The housing 12 may comprise a first housing portion 16 and a second housing portion 18. The first housing portion 16 may be engagable with the second housing portion 18 to form the housing 12. The first housing portion 16 may be snap fit, press fit, or otherwise engaged with the second housing portion 18. In one embodiment, the second housing portion 18 may have a lip 20 extending therefrom and a plurality of tabs 22 configured to engage a portion of the first housing portion 16 (e.g., a recess or aperture in the first housing portion 16) such that the first housing portion 16 may be removably attached to the second housing portion 18. In other embodiments, the first housing portion 16 and the second housing portion 18 may be pivotably attached to each other such that they may pivot relative to each other to allow access to the cavity 14. In various embodiments, the first housing portion 16 may be separated from or pivoted away from the second housing portion 18 to refill sanitary tissue products 15 in the cavity 14 formed by the housing 12. In other embodiments, another portion of the housing 12 may open or have a door so that sanitary tissue products 15 may be inserted into and removed from the cavity 14.

Figure 1A:
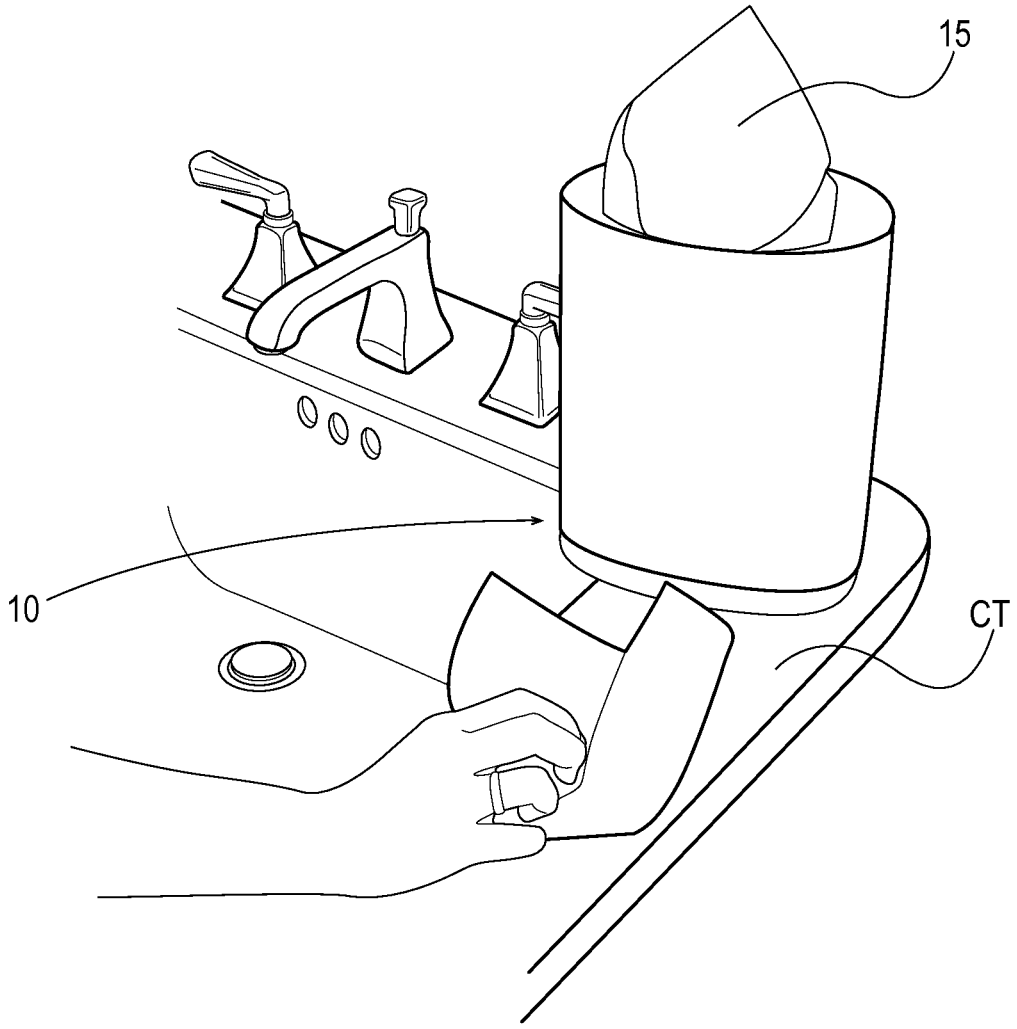
FIG. 1A is a photograph of a dispenser of the present disclosure positioned on a countertop in accordance with one non-limiting embodiment.
Figure 1B:
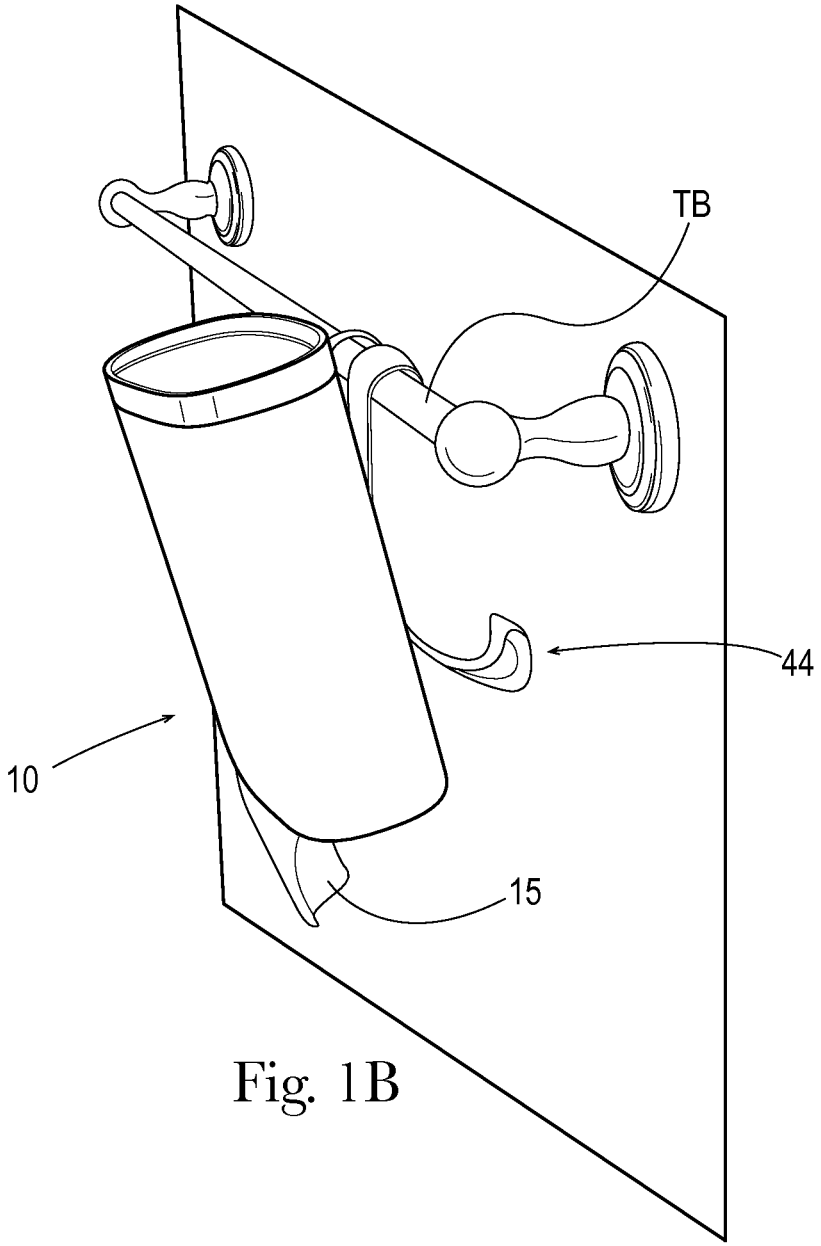
FIG. 1B is a photograph of a dispenser and a hanger of the present disclosure engaged with a towel bar in accordance with one non-limiting embodiment.
Figure 1C:
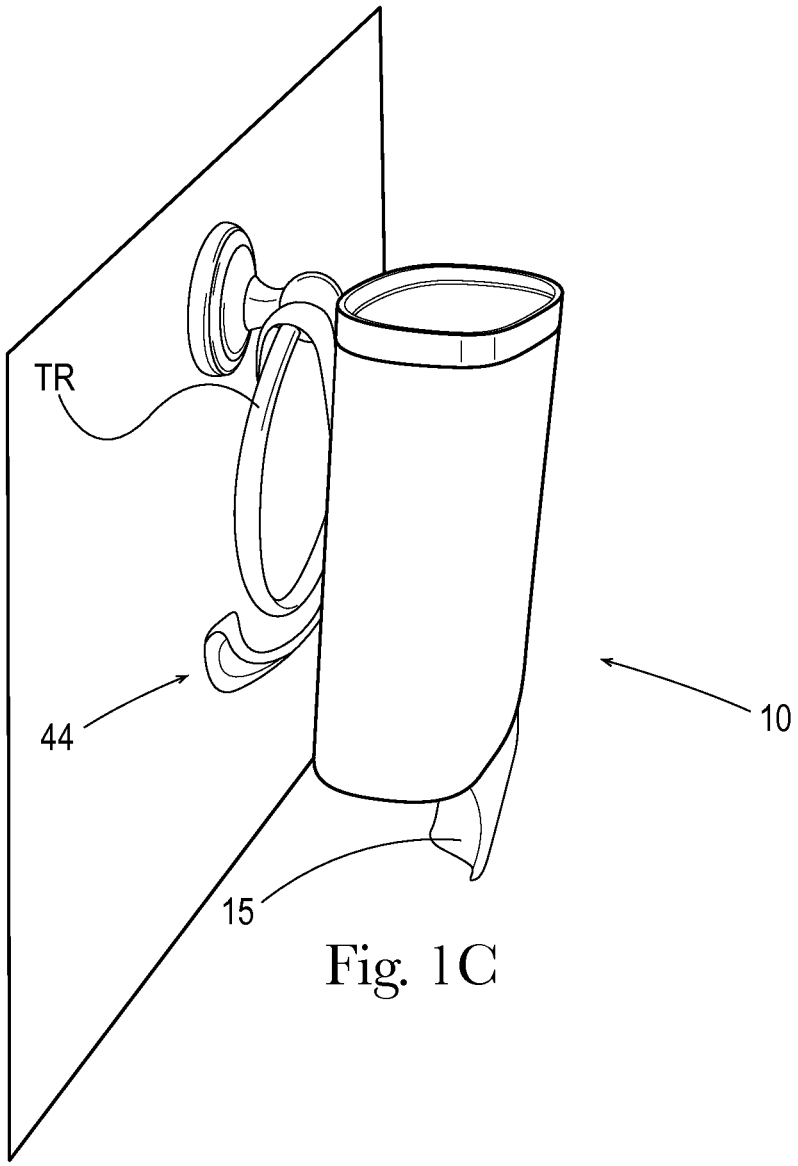
FIG. 1C is a photograph of the dispenser and hanger of FIG. 1B engaged with a towel ring in accordance with one non-limiting embodiment.
Figure 2:
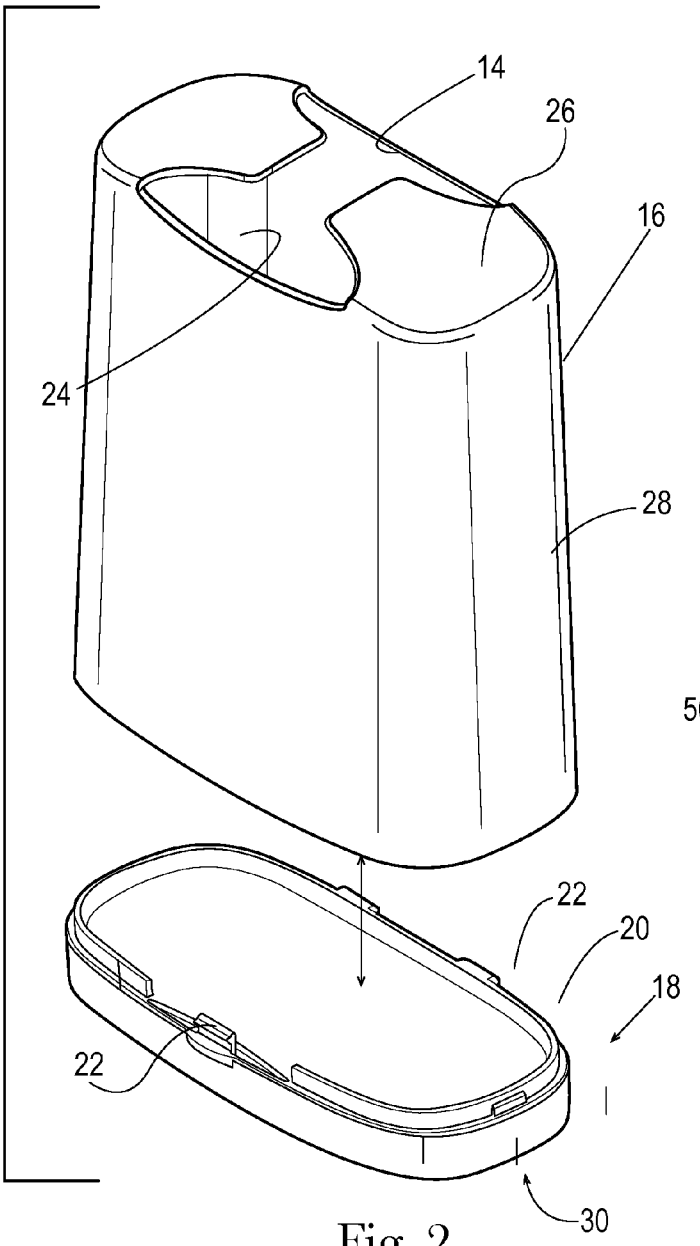
FIG. 2 is an exploded front perspective view of a housing of the dispenser of FIG. 1 in accordance with one non-limiting embodiment.
Figure 3:
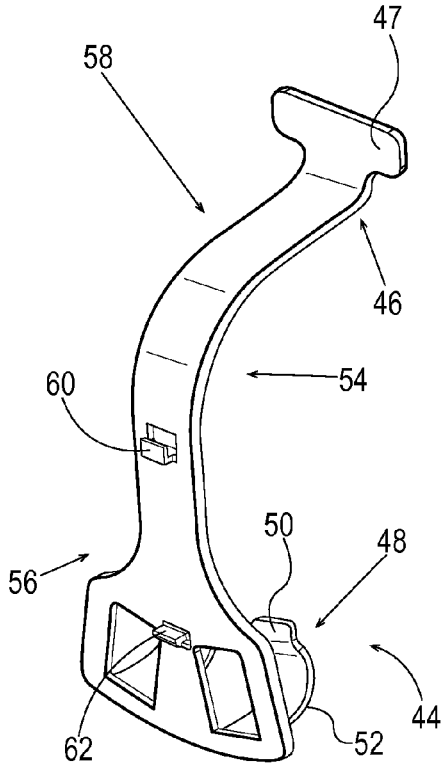
FIG. 3 is a front perspective view of the hanger that is attached to the dispenser of FIG. 1 in accordance with one non-limiting embodiment.

In one embodiment, the dispenser 10 for sanitary tissue products 15 may be positioned on a countertop "CT" as illustrated in FIG. 1A, engaged with or removably engaged with a towel bar "TB" using a hanger as illustrated in FIG. 1B, and/or engaged with or removably engaged with a towel ring "TR" using the hanger as illustrated in FIG. 1C. The dispensers 10 may be removably engaged with the towel bar or towel ring using a hanger 44, as discussed in greater detail herein. Other positioning of the dispensers of the present disclosure is also contemplated.

In various embodiments, the housing may comprise a top wall 26, one or more side walls 28, and a bottom wall 30. The top wall 26 and at least portion of, or all of, the one or more side walls 28 may be formed by the first housing portion 16. A portion of the one or more side walls 28 may also be formed by the second housing portion 18. The bottom wall 30 may be formed by the second housing portion 18. An opening 24 may be defined in the top wall 26 and/or a portion of the one or more side walls 28 of the first housing portion 16. The opening 24 may have an I-like shape, as illustrated in various figures or other suitable shapes configured to provide the same benefits discussed herein.

In various embodiments, referring to FIGS. 9A-12C, the opening 24 may have a first portion 32, a second portion 34, and a third portion 36. The various portions are separated by dashed lines. The third portion 36 may extend between or connect the first portion 32 and the second portion 34. The opening 24 may extend over all of, or part of, a stack of sanitary tissue products 15 (see e.g., FIGS. 1, 10, and 11). By providing the opening 24 which extends over all of, or most of, the stack of vertically orientated sanitary tissue products 25, a user can easily reach through a portion of the opening 24 and pull out a sanitary tissue product 15 regardless of how many sanitary tissue products 15 are positioned within the cavity 14. In one embodiment, the distance between a perimeter wall of the opening 24 to the top of a stack of the sanitary tissue products 15 may be the same, or generally the same (e.g., +/− one inch), owing to the shape of the opening 24, regardless of whether the stack of the sanitary tissue products 15 within the cavity 14 is full or almost used up. This feature provides a benefit over related art dispensers. The configuration of the opening 24 may allow a front sanitary tissue product 15 (i.e., a sanitary tissue product under the first portion 32) to be exposed by the first portion 32 of the opening 24, may allow a rear sanitary tissue product (i.e., a sanitary tissue product under the second portion 34) to be exposed by the second portion 34 of the opening 24, and may allow a middle sanitary tissue product (i.e., a sanitary tissue product under the third portion 36) to be exposed by the third portion 36 of the opening 24. As such, regardless of how many sanitary tissue products 15 remain within the cavity 14, a user may have direct access to the front most sanitary tissue product in the stack (e.g., the sanitary tissue product positioned furthest away from the hanger 44). The shape, positioning, and/or orientation of the opening 24 may reduce "fall back" of the sanitary tissue products 15 as well. Fall back is when one sanitary tissue product is dispensed through the opening 24 and it does not pull another sanitary tissue product 15 from the stack of the sanitary tissue products 15 partially through the opening 24 into a dispensing position when the sanitary tissue products 15 are interleaved. A sanitary tissue product 15 in a dispensing position may extend partially through the opening 24 such that a user can easily grasp it without having to reach into and through the opening 24. The shape of the opening 24 may reduce the incidences of fall back of the sanitary tissue products 15 by about 10% when compared to other shaped openings that do not extend across a stack of sanitary tissue products positioned within the cavity 14. Although the openings of the present disclosure are discussed with respect to dispenser 10, the present disclosure envisions that the openings may be provided on any type of dispenser configured to dispense sanitary tissue products or other products.

In one embodiment, the shape, positioning, and/or orientation of the opening 24 may provide a number of benefits. First, the first portion 32 of the opening 24 being generally wider or larger in area or perimeter than the third portion 36 of the opening 24 may allow a user to dispense a sanitary tissue product easily and without tearing when the cavity 14 is full of sanitary tissue products and the pressure between each sanitary tissue product is relatively high owing to compression of the sanitary tissue products 15 within the cavity 14. Second, the second portion 34 of the opening 24 being wider or larger in area or perimeter than the third portion 36 may allow a user to easily grasp and dispense sanitary tissue products, without tearing, when only a few sanitary tissue products remain in the rear of the cavity 14 and the pressure between each sanitary tissue product is relatively low. Third, the third portion 36 of the opening 24 being generally narrower or having a smaller area or perimeter than the first and second portions 32 and 34 may help hold the sanitary tissue products in a partially dispensed position and allow a user to have direct access to the top of the sanitary tissue products when the cavity is about half full of sanitary tissue products. Some other example openings 100-104 that can achieve the same, or similar, advantages as the opening 24 are illustrated in FIGS. 13A-13D. The first portions of the openings 100-104 are labeled "1," the second portions of the openings 100-104 are labeled "2," and the third portions of the openings 100-104 are labeled "3". The openings 100-104 are defined in a top wall 126 and/or a side wall of a dispenser. Portions of the first and second portions 1 and 2 may extend at least partially onto a side wall of a dispenser. In various embodiments, any of the first, second, and third portions of the openings may not be provided. For instance, the second portion, in some embodiments, may not be provided.

Figure 9A:
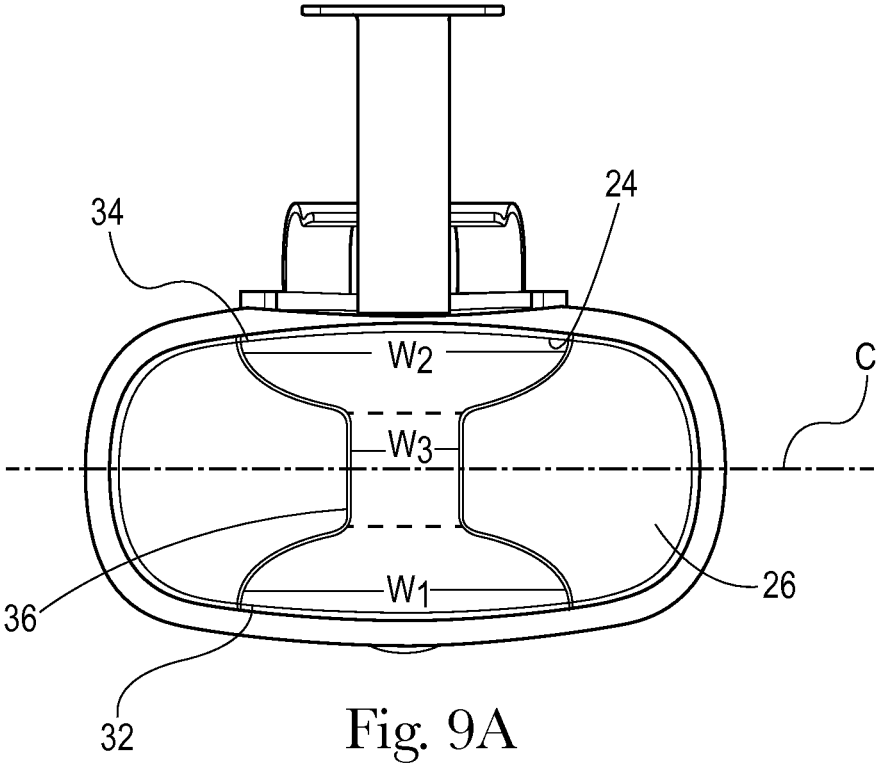
FIGS. 9A-9C are top views of the dispenser and hanger of FIG. 1 illustrating an opening in the dispenser in accordance with various non-limiting embodiments.
Figure 12A:
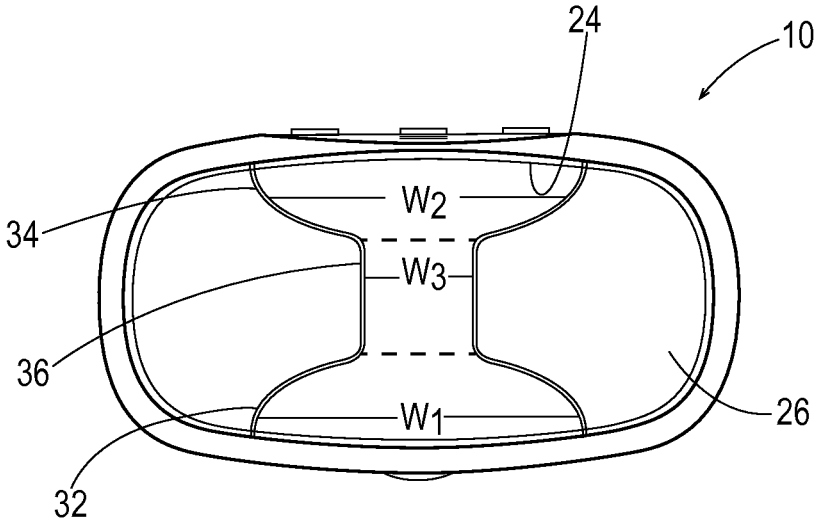
FIG. 12A-12C are top views of another dispenser illustrating an opening in accordance with various non-limiting embodiments.

In various embodiments, referring to FIGS. 9A and 12A, the first portion 32 of the opening 24 may have a first width W1, the second portion 34 of the opening 24 may have a second width W2, and the third portion 36 of the opening 24 may have a third width W3. The first width W1 of the first portion 32 and the second width W2 of the second portion 34 may both be larger than the third width W3 of the third portion 36. In one embodiment, referring to FIG. 9A, the first width W1 of the first portion 32 may be the same, or substantially the same, as the second width W2 of the second portion 34. In another embodiment, referring to FIG. 12A, the first width W1 of the first portion 32 may be larger than the second width W2 of the second portion 34 or vice versa. In such an embodiment, the second width W2 of the second portion 34 may still be larger than the third width W3 of the third portion 36. The widths may be measured using a length measurement device, such as a ruler or a tape measure. The widths should be measured on or parallel to a central axis, C, of the dispenser (see e.g., FIG. 9A) at the widest part of each portion of the opening 24. The third width W3 would be measured on, or proximate to, the central axis of the dispenser 10, while the first and second widths W1 and W2 may be measured parallel to the central axis, C, of the dispenser 10. Alternatively, the width may be measured by obtaining a dispenser, scanning a portion of the dispenser defining the opening using a Computed Tomography (CT) Scanning Machine to obtain a digital image of the opening and a surrounding portion of the dispenser, and then using any commercially available 3D CAD software program, such as SOLIDWORKS® or PRO/ENGINEER®, for example, to calculate the width of the various portions of the opening based on the scanned image. Again, here, the widths may be measured parallel to the central axis, C.

Figure 9B:
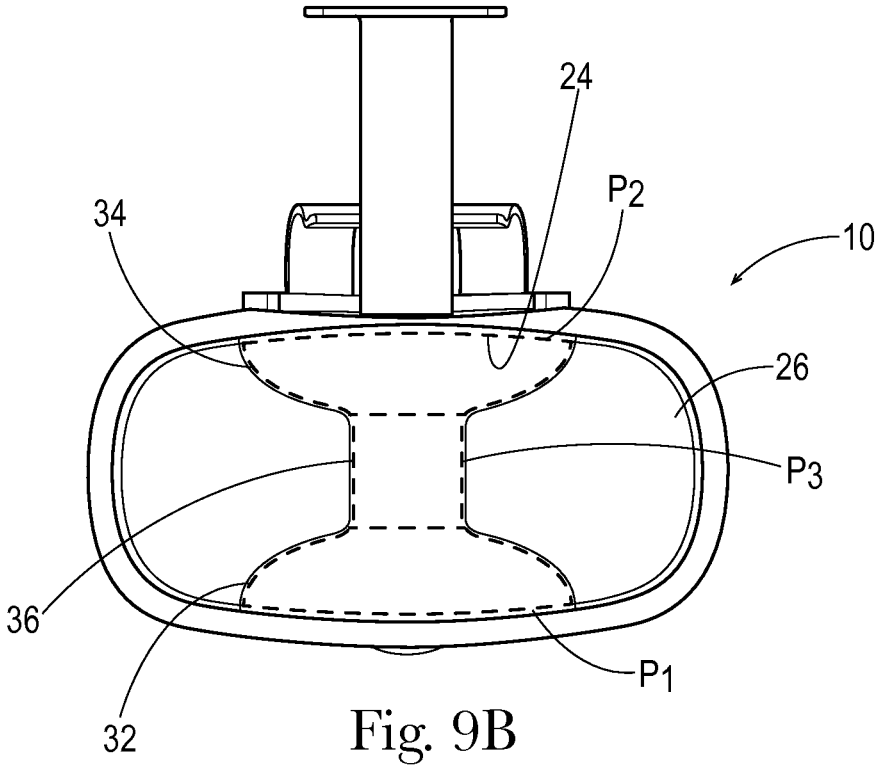
Figure 12B:
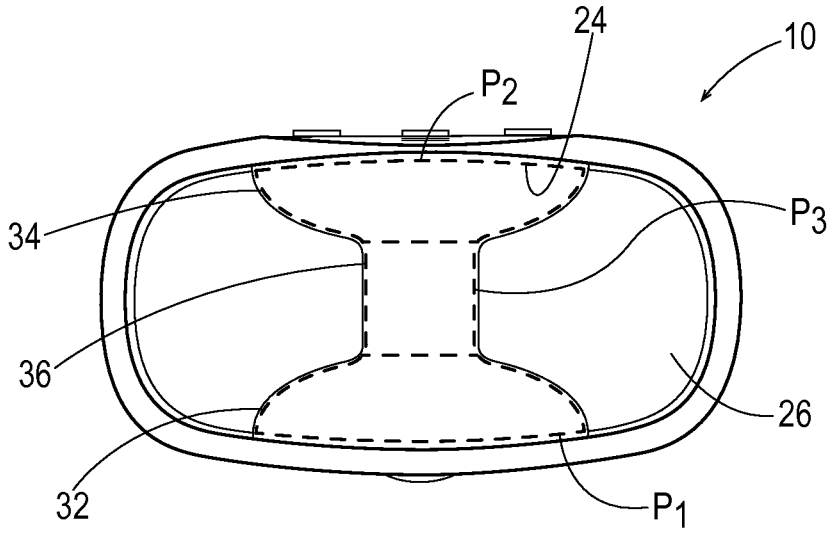

In various embodiments, referring to FIGS. 9B and 12B, the first portion 32 of the opening 24 may have a first perimeter P1, the second portion 34 of the opening 24 may have a second perimeter P2, and the third portion 36 of the opening 24 may have a third perimeter P3. The first perimeter P1 of the first portion 32 and the second perimeter P2 of the second portion 34 may both be larger than the third perimeter P3 of the third portion 36. In one embodiment, referring to FIG. 9B, the first perimeter P1 of the first portion 32 may be the same, or substantially the same, as the second perimeter P2 of the second portion 34. In another embodiment, referring to FIG. 12B, the first perimeter P1 of the first portion 32 may be larger than the second perimeter P2 of the second portion 34 or vice versa. In such an embodiment, the second perimeter P2 of the second portion 34 may still be larger than the third perimeter P3 of the third portion 36. The perimeters may be measured using a length measurement device, such as a flexible ruler or tape measure. Alternatively, the perimeters may be measured by obtaining a dispenser, scanning a portion of the dispenser defining the opening using a Computed Tomography (CT) Scanning Machine to obtain a digital image of the opening and a surrounding portion of the dispenser, and then using any commercially available 3D CAD software program, such as SOLIDWORKS® or PRO/ENGINEER®, for example, to calculate the perimeter of the various portions of the opening based on the scanned image.

Figure 9C:
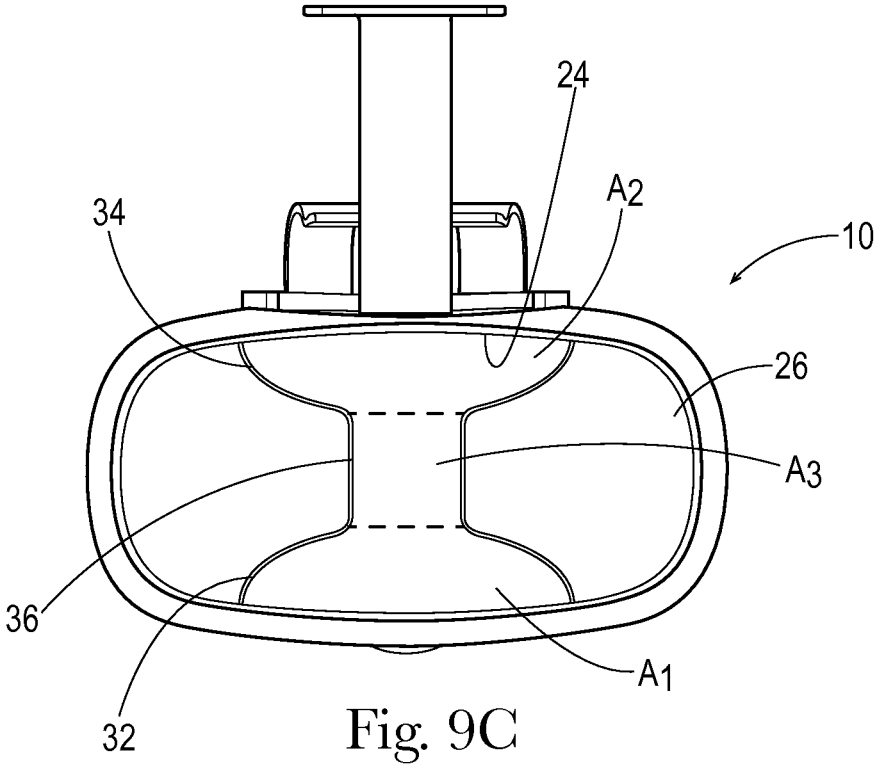
Figure 10:
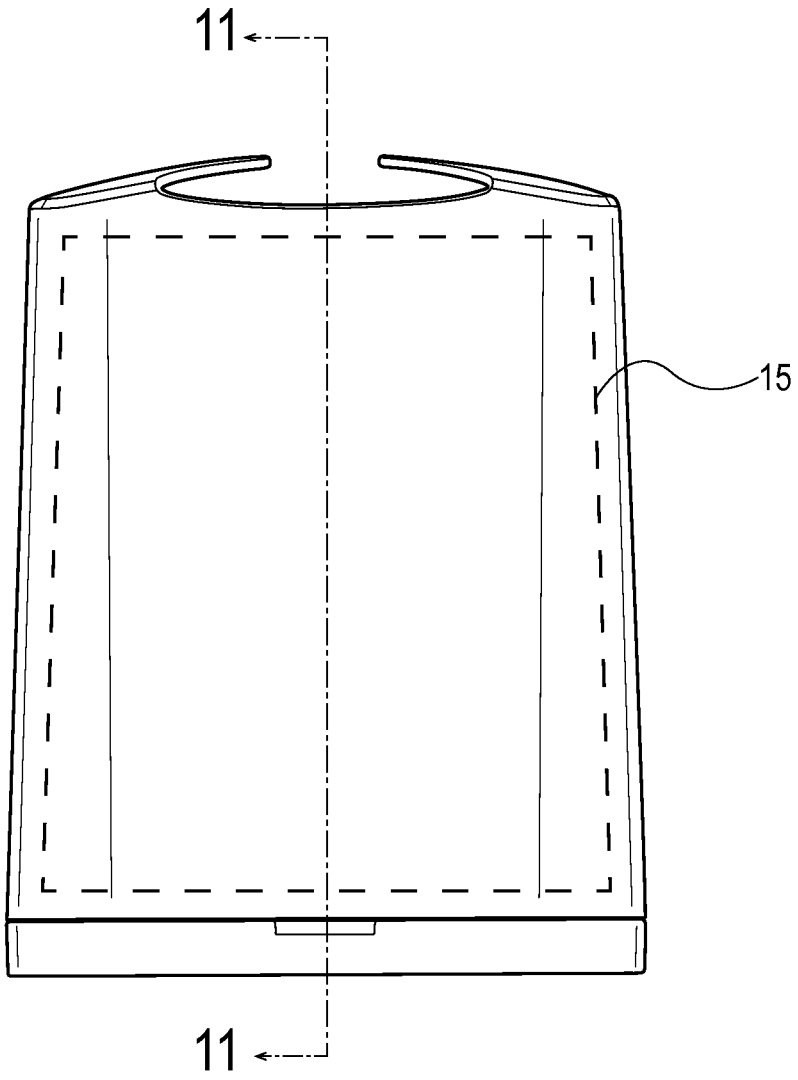
FIG. 10 is a front view of the dispenser of FIG. 1 in accordance with one non-limiting embodiment.
Figure 12C:
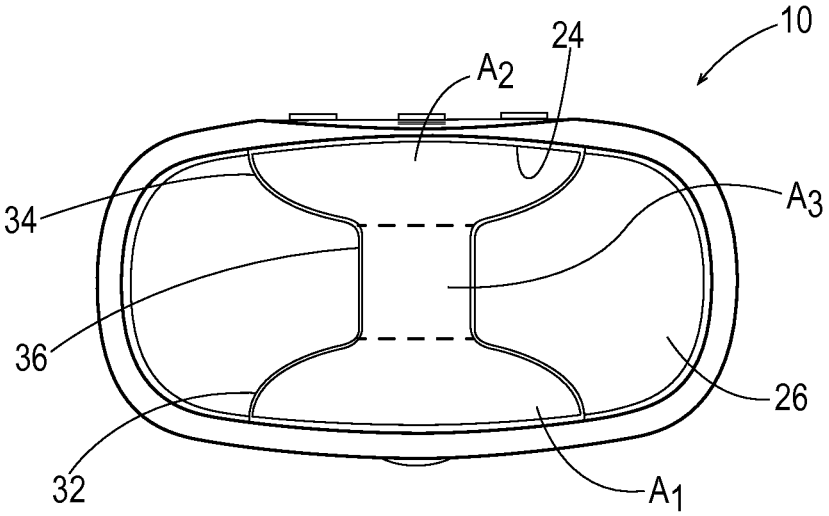
Figure 13B:
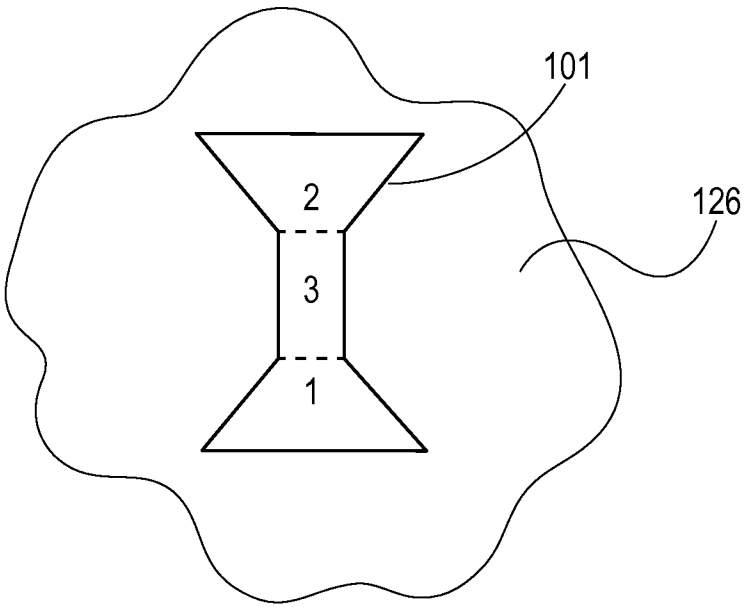
FIGS. 13A-13D are illustrations of other opening shapes that may be provided on the dispensers of the present disclosure in accordance with various non-limiting embodiments.
Figure 13A:
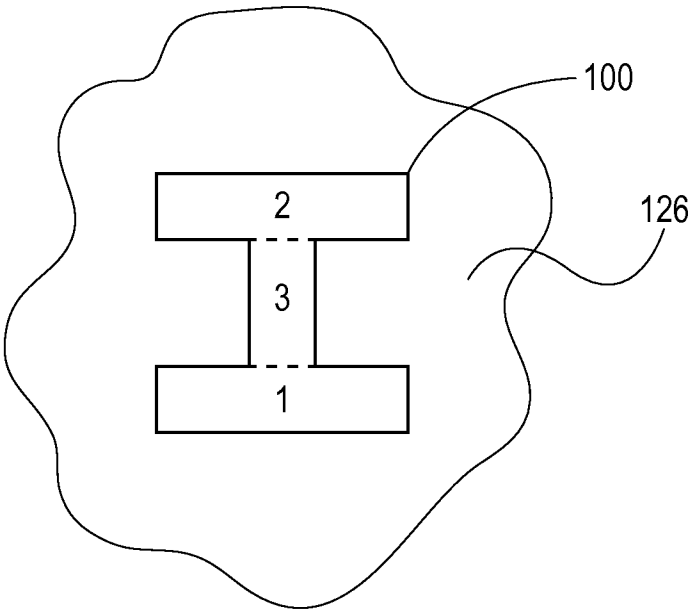
Figure 13D:
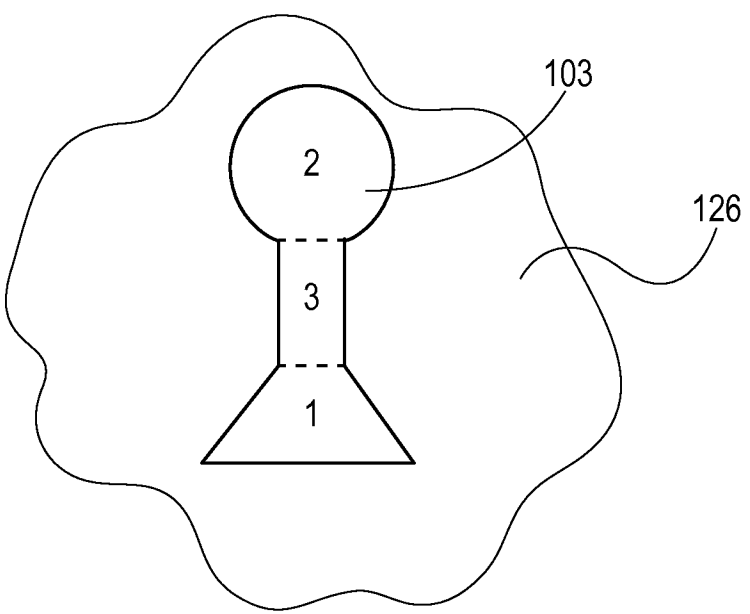
Figure 13C:
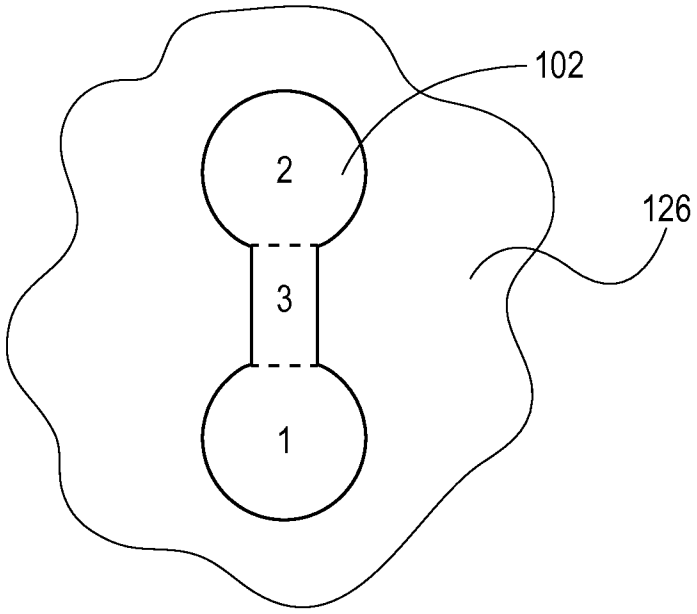
Figure 14:
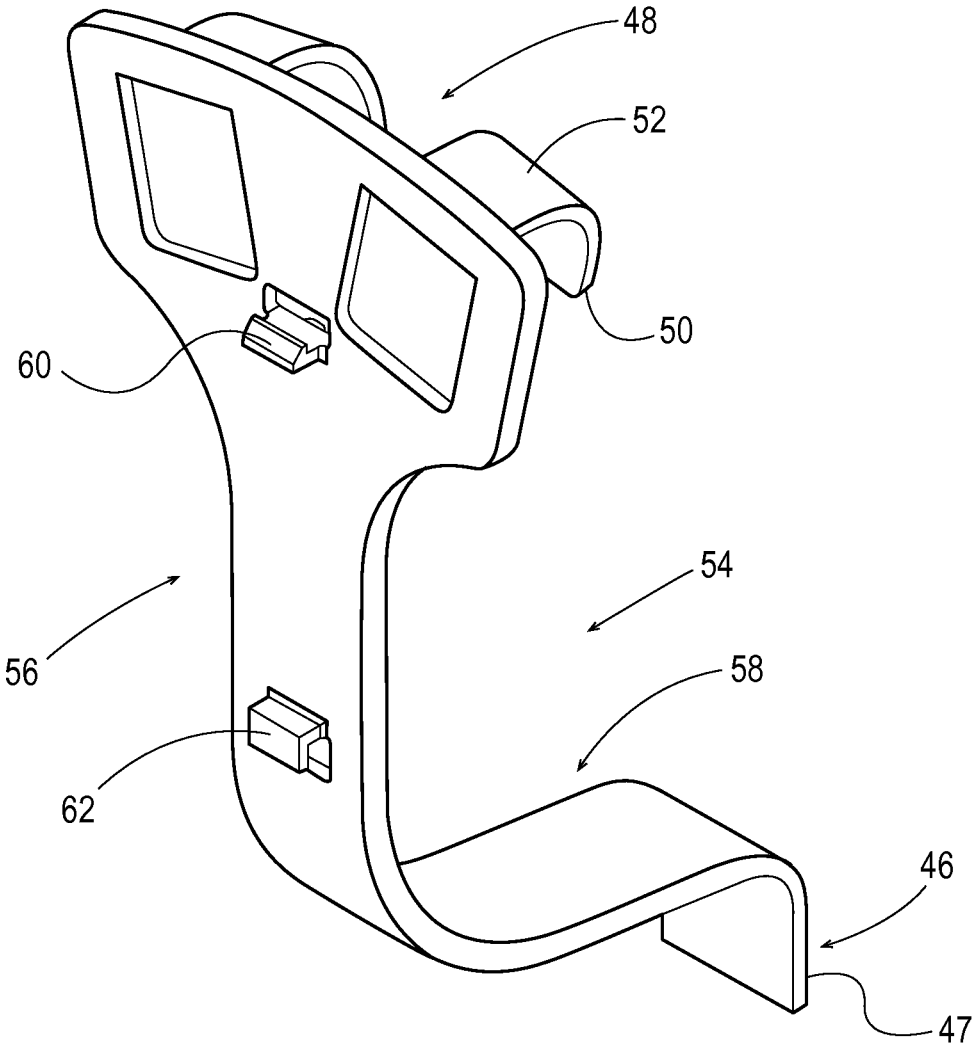
FIG. 14 is a front perspective view of the hanger of FIG. 1 in accordance with one non-limiting embodiment.

In various embodiments, referring to FIGS. 9C and 12C, the first portion 32 of the opening 24 may have a first area A1, the second portion 34 of the opening 24 may have a second area A2, and the third portion 36 of the opening 24 may have a third area A3. The first area A1 of the first portion 32 and the second area A2 of the second portion 34 may both be larger than the third area A3 of the third portion 36. In one embodiment, referring to FIG. 9C, the first area A1 of the first portion 32 may be the same, or substantially the same, as the second area A2 of the second portion 34. In another embodiment, referring to FIG. 12C, the first area A1 of the first portion 32 may be larger than the second area A2 of the second portion 34 or vice versa. In such an embodiment, the second area A2 of the second portion 34 may still be larger than the third area A3 of the third portion 36. The areas may be measured by obtaining a dispenser, scanning a portion of the dispenser defining the opening using a Computed Tomography (CT) Scanning Machine to obtain a digital image of the opening and a surrounding portion of the dispenser, and then using any commercially available 3D CAD software program, such as SOLIDWORKS® or PRO/ENGINEER®, for example, to calculate the area of the various portions of the opening based on the scanned image.

Figure 5:
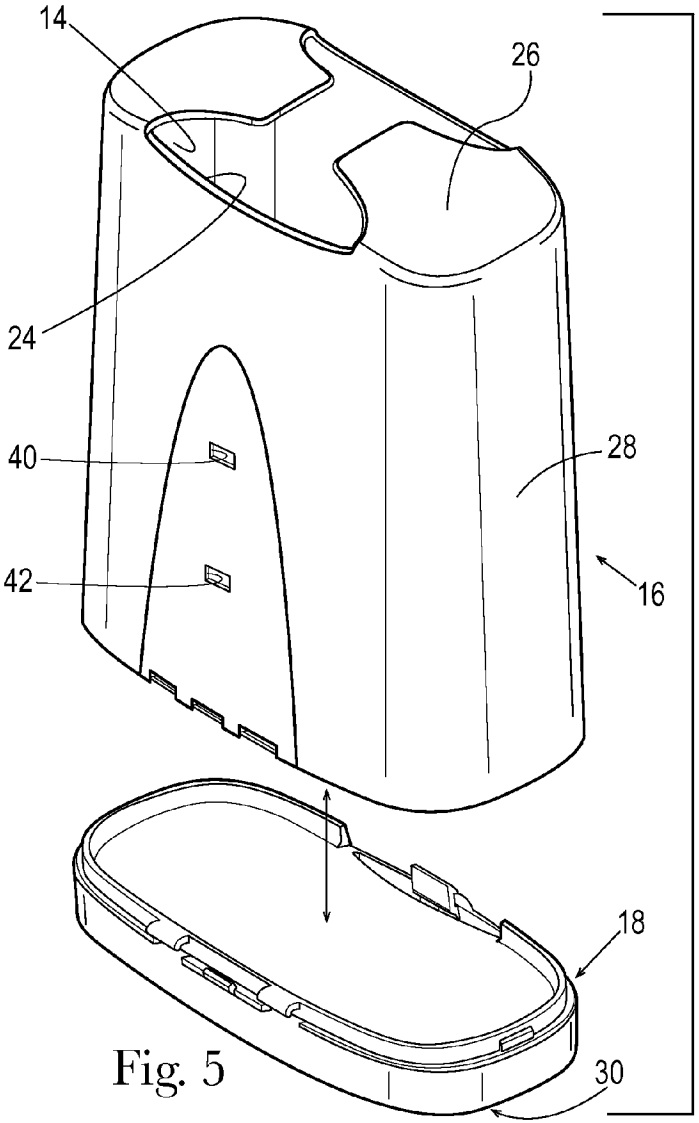
FIG. 5 is an exploded rear perspective view of a housing of the dispenser of FIG. 1 in accordance with one non-limiting embodiment.
Figure 4:
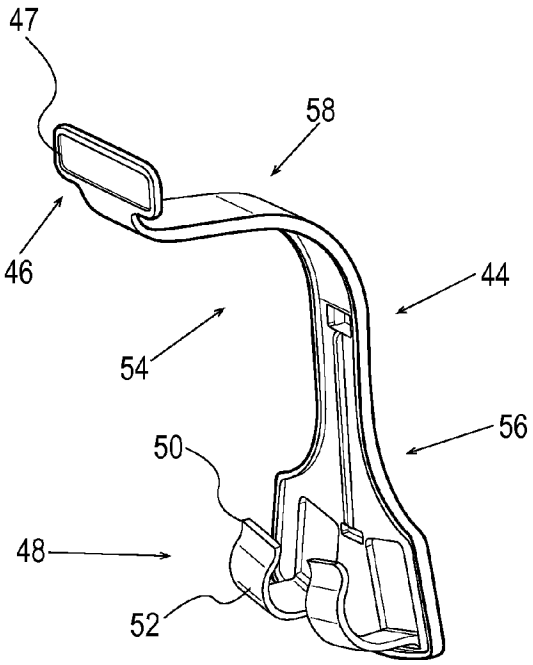
FIG. 4 is a rear perspective view of the hanger that is attached to the dispenser of FIG. 1 in accordance with one non-limiting embodiment.
Figure 6:
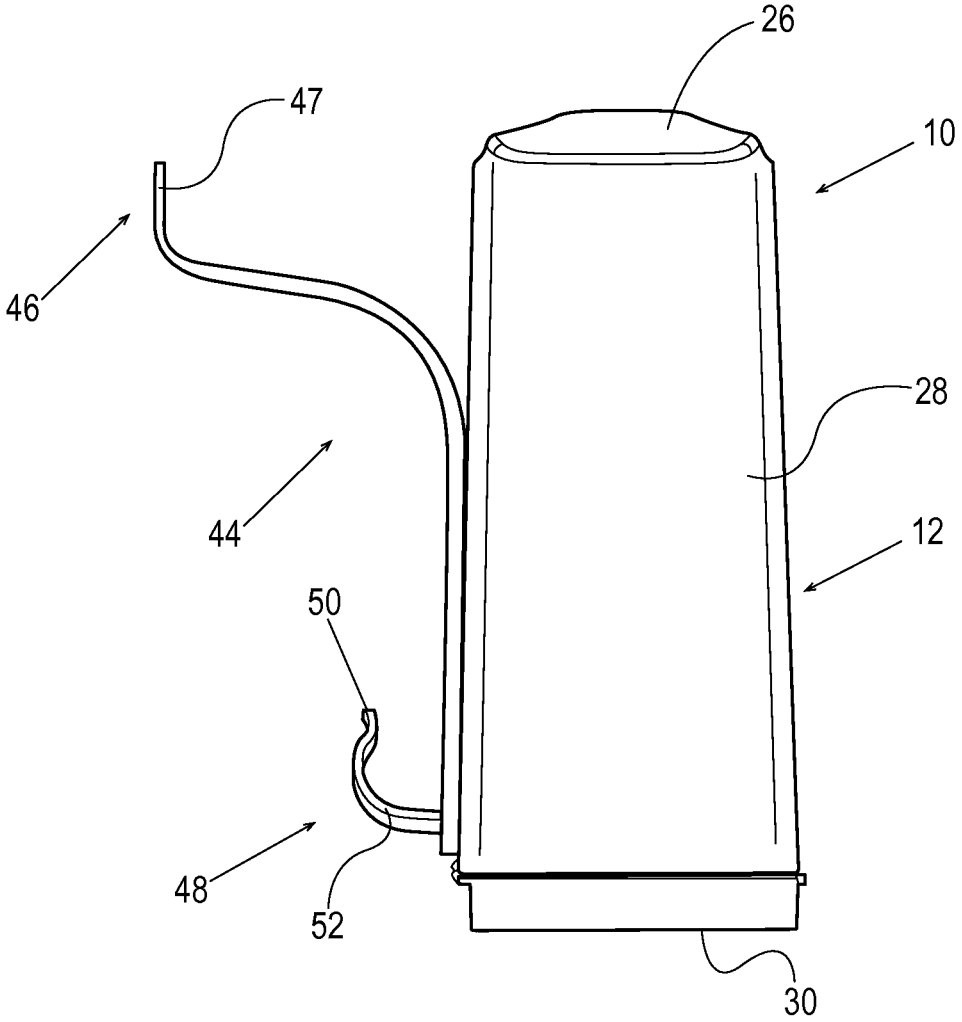
FIG. 6 is a side perspective view of the dispenser and hanger of FIG. 1 in accordance with one non-limiting embodiment.
Figure 7:
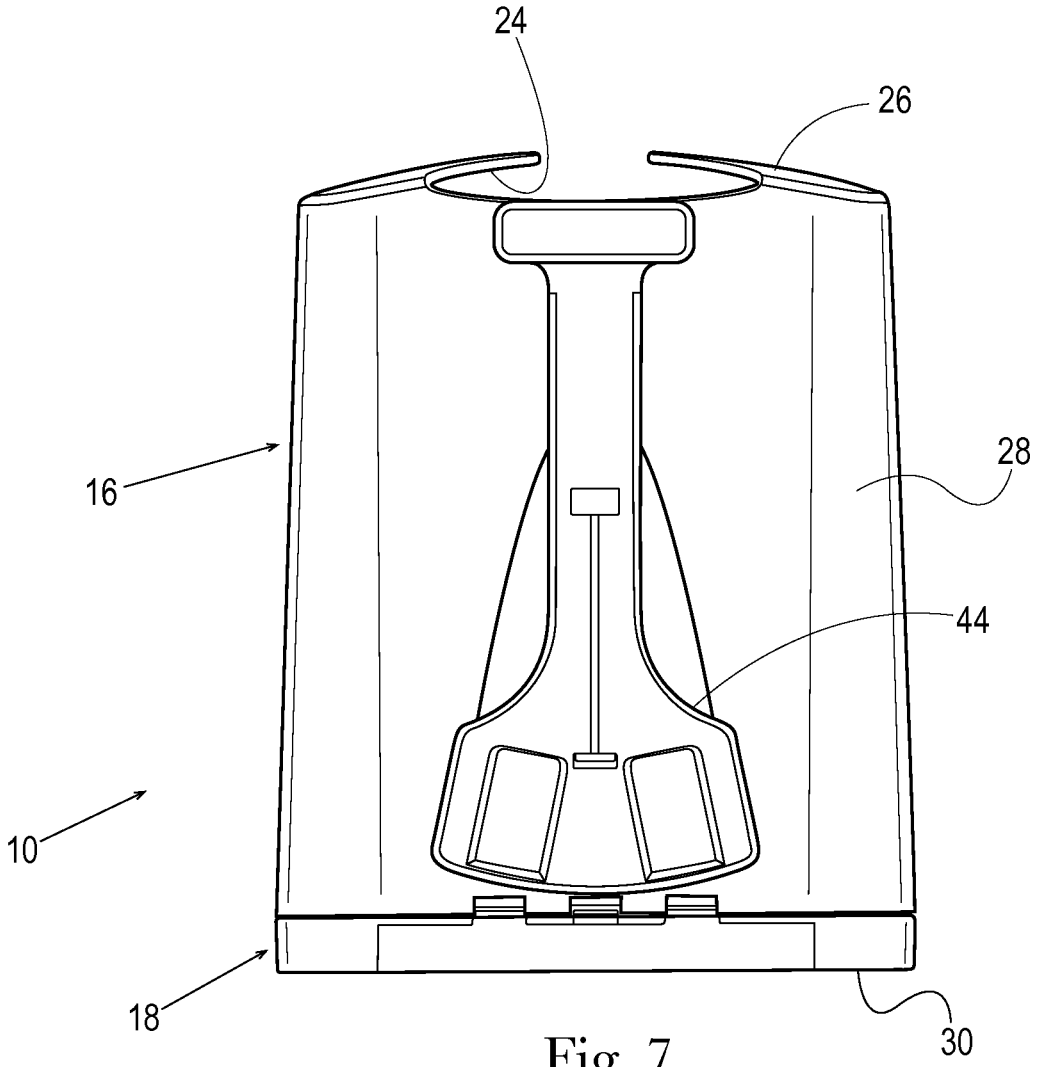
FIG. 7 is a rear view of the dispenser and hanger of FIG. 1 in accordance with one non-limiting embodiment.
Figure 8:
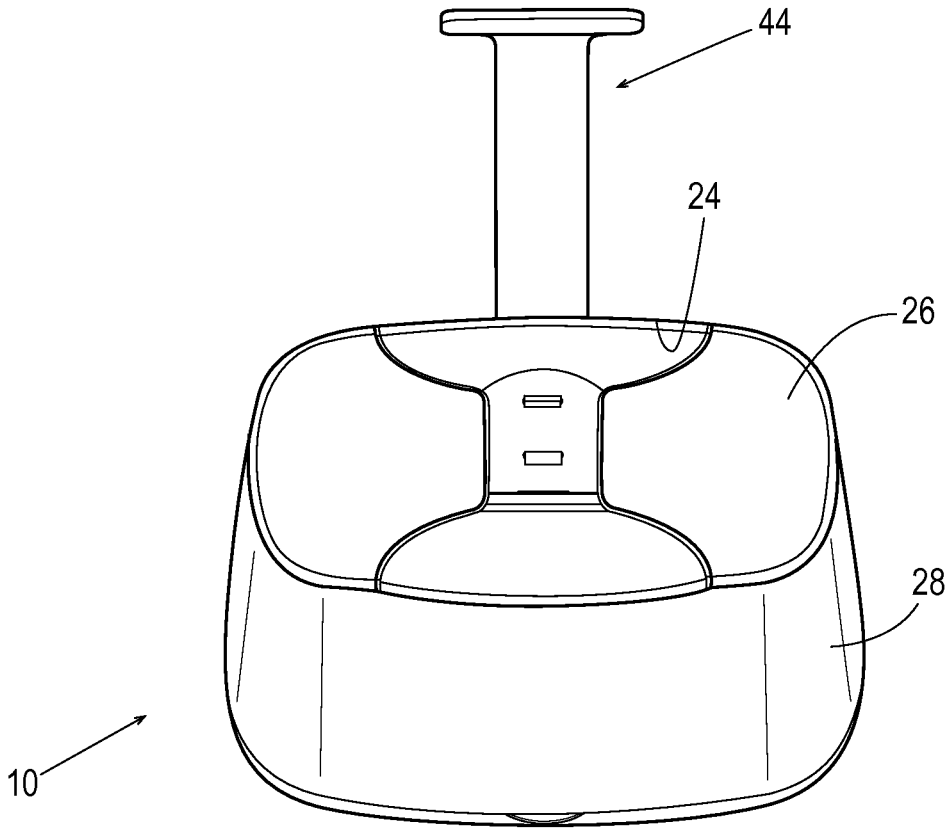
FIG. 8 is a top perspective view of the dispenser and hanger of FIG. 1 in accordance with one non-limiting embodiment.
Figure 11:
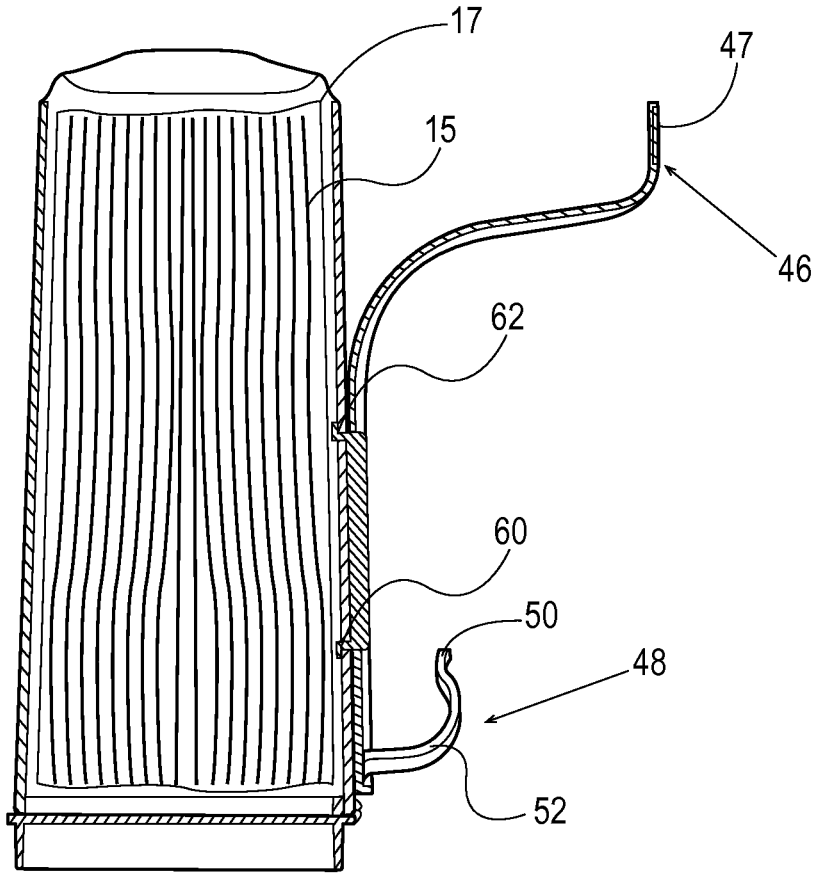
FIG. 11 is a cross-sectional view of the dispenser and the hanger of FIG. 1 taken about line 11-11 of FIG. 10 in accordance with one non-limiting embodiment.

In one embodiment, referring to FIGS. 5 and 11, one of the side walls 28 may define a first aperture 40 and a second aperture 42 therein. The first and second apertures 40 and 42 may be used to releasably engage or attach a hanger 44 to a side wall 28 of the dispenser 10. An example hanger 44 is illustrated in FIGS. 3, 4, 6-9C, 11, and 14-16. Referring to FIGS. 3, 4, 6, 11, and 14-16, the hanger 44 may comprise a first end portion 46 comprising a base 47 configured to engage a surface, such as a wall, when the dispenser 10 is hung from a towel ring, a towel bar, a door, and/or other member. The base 47 may comprise a flat surface or a generally flat surface. The hanger 44 may comprise a second end portion 48 comprising one or more hooks 50 configured to engage a towel bar, door, or a towel ring. The one or more hooks 50 may each comprise an arcuate portion 52 configured to engage an arcuate portion on a towel bar or a towel ring. In other embodiments, the hooks 50 may have any other suitable shape configured to engage a particular towel bar, towel ring, or other member. The hanger 44 may comprise a body 54 disposed intermediate the first end portion 46 or base 47 and the second end portion 48 or the one or more hooks 50. The body 54 may comprise a first portion 56 and a second portion 58. The first portion 56 may comprise one or more engagement members extending therefrom, such as a first engagement member 60 and a second engagement member 62. The first engagement member 60 may be configured to engage perimeter walls of the first aperture 40 in a side wall 28 of the dispenser 10 and the second engagement member 62 may be configured to engage perimeter walls of the second aperture 42 in the side wall 28 of the dispenser 10 such that the hanger 44 is removably attached to the dispenser 10. The engagement members 60 and 62 may have any suitable shape to engage apertures, or other portions of, the dispensers 10.

Figure 15:
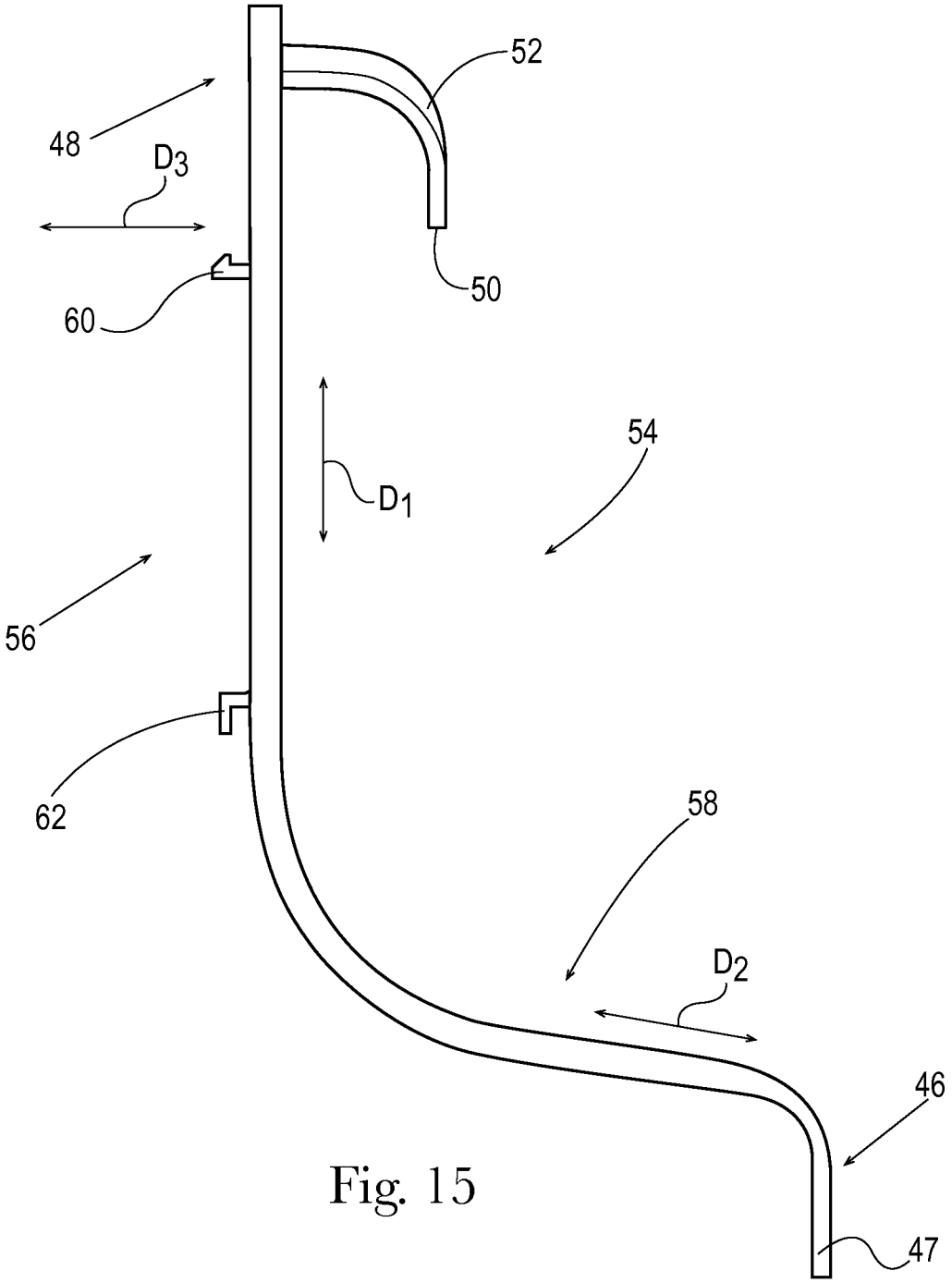
FIG. 15 is a side view of the hanger of FIG. 14 in accordance with one non-limiting embodiment.
Figure 16:
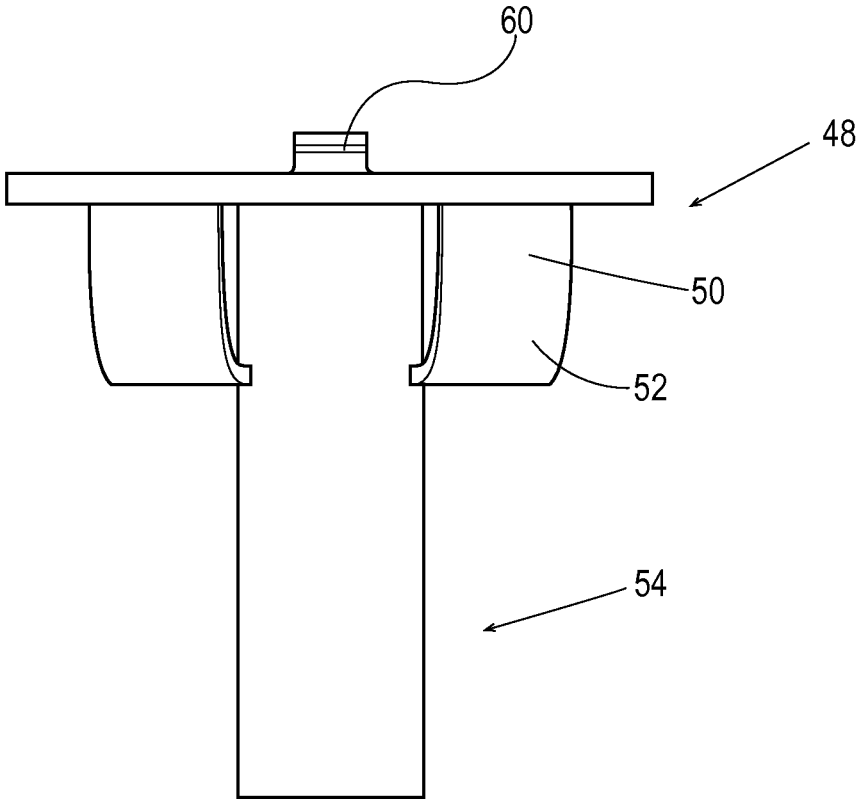
FIG. 16 is a top view of the hanger of FIG. 14 in accordance with one non-limiting embodiment.

In one embodiment, referring to FIG. 15, the first portion 56 of the body 54 may extend in a first direction D1 and the second portion 58 of the body 54 may extend in a second direction D2. The first direction D1 may be different than the second direction D2. The base 47 may extend generally (e.g., 1-20 degrees) in the first direction D1. The first direction D1 may be transverse, generally perpendicular, or perpendicular to the second direction D2. A portion of the first engagement member 60 may extend outwardly from the first portion 56 of the body 54 in a third direction D3 and the second portion 58 of the body 54 may extend generally (e.g., 1-20 degrees) in the third direction.

The dispenser 10 and the hanger 44 described herein may be sold together as a kit or sold separately.

In one embodiment, the cavities of the various dispensers may be configured to receive any number of unpackaged sanitary tissue products or one or more packages or refills of sanitary tissue products. In various embodiments, the sanitary tissue products may be stacked, folded, interleaved, rolled, or otherwise suitably manufactured and/or arranged such that they may be easily dispensed from the dispensers through the opening. In certain embodiments, the sanitary tissue products may be suitably manufactured and/or arranged such that one individual sanitary tissue product may be dispensed at a time. In the event that the sanitary tissue products are packaged or packaged into refills, they may be packaged using a film wrapper, a polymeric film wrapper, a paper wrapper, a wrapper comprising cellulosic and/or nonwoven fibers, a container, and/or any other suitable sanitary tissue product covering and/or containing material. Referring to FIGS. 1 and 11, a wrapper 17 having sanitary tissue products 15 positioned therein (i.e., a refill) may have an opening defined therein or creatable therein. The opening may be at least partially aligned with the opening 24 when the refill is positioned within the cavity 14. The sanitary tissue products 15 may be dispensed through the opening in the wrapper 17 and the opening 24. The opening in the wrapper 17 and the opening 24 may create frictional forces on the sanitary tissue products 15 to aid in dispensing one sanitary tissue product 15 at a time. The frictional forces on the sanitary tissue products 15 may also enable one sanitary tissue product to remain in a partially dispensed position (i.e., a position in which a sanitary tissue product 15 extends partially through the opening 24).

In one embodiment, refills of sanitary tissue products may be used with the dispensers of the present disclosure. The refills may comprise a plurality of sanitary tissue products configured to be dispensed using the dispenser. In various embodiments, the shape and size of the refills may be dependent on the shape and/or size of a particular cavity of a dispenser and/or the shape and/or size of a dispenser. In one embodiment, the refills may have a similar size and/or shape as the cavities into which they are to be positioned or a different size and/or shape (e.g., a smaller size).

In one embodiment, the dispensers of the present disclosure may be reusable or disposable. Disposable dispensers may be comprised of cellulosic fibers, such as paper, paper stock, cardboard, paperboard, other fibers, and/or other suitable or biodegradable materials. In general, disposable dispensers may be purchased with a plurality of sanitary tissue products positioned in a cavity thereof and such dispensers may or may not be refillable. Reusable dispensers may be comprised of paperboard, plastic, metal, wood, anti-microbial materials, anti-bacterial materials, anti-microbial materials, and/or any other suitable materials. In general, reusable dispensers may be purchased with or without sanitary tissue products positioned in a cavity thereof or with or without a refill of sanitary tissue products positioned therein. These reusable dispenses may be multi-use dispensers. When the supply of sanitary tissue products within a reusable dispenser is exhausted, a consumer may insert additional sanitary tissue products or a refill of additional sanitary tissue products into the cavity of the reusable dispenser. The refills may be purchased at the same store or location as the reusable dispenser was purchased. The refills may comprise films, polymeric films, and/or materials comprising cellulosic fibers, nonwoven fibers, or other materials, surrounding a plurality of sanitary tissue products. In one embodiment, a kit comprising a dispenser, one or more refills, and a hanger may be provided.

In one embodiment, the refills and/or the dispensers may comprise a perfume therein or thereon. In other embodiments, the sanitary tissue products within the refills may comprise the perfume. In still other embodiments, the film or other material forming the outer covering of the refills may comprise the perfume. Once inserted into a cavity of the dispenser, the perfume may diffuse through an aperture, a slot, or an opening in the dispenser into an environment surrounding the dispenser to provide a pleasant scent to the environment. In various embodiments, the dispensers of the present disclosure may have slots, apertures, or recesses therein configured to receive scent packets, such that a scent may be diffused into an environment surrounding the dispensers. In other embodiments, the scent packets may be attachable to the dispensers.

The various dispensers of the present disclosure may comprise transparent or see through "windows" that enable a consumer to view into the cavity of a dispenser and/or into a refill to determine how many sanitary tissue products remain or to determine the status of the sanitary tissue products. In one embodiment, at least a portion of a film surrounding a refill may be transparent or see through to allow a user to view the sanitary tissue products within the refill. The dispensers and/or the refills may comprise indicia, such as branding information, thereon or formed in outer surfaces thereof. In one embodiment, portions of the dispensers may comprise one or more light sources that may act as night lights, for example. In various embodiments, the one or more light sources, such as light emitting diodes or light bulbs, for example, may be operably linked to switches or motion detectors to activate the light sources. The lights sources may be powered by any suitable sources, such as a battery, for example. In one embodiment, the dispensers may comprise one or more sealing members configured to seal the cavities of the dispensers to at least inhibit air from entering and exiting the cavity. Such seals may be useful when sanitary tissue products, such as wet wipes, are positioned within the cavities to at least inhibit the wet wipes from drying out. In other embodiments, the seals may be useful in inhibiting contamination, such as dirt, from entering the cavities. In various embodiments, a flexible membrane may extend into the openings of the dispensers. The flexible membrane may have one or more openings therein for dispensing sanitary tissue products, such as wet wipes, therethrough. The flexible membrane may help maintain sanitary tissue products, such as wet wipes, within a cavity of a dispenser in a wet or sanitary condition.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any embodiment disclosed or claimed herein or that it alone, or in any combination with any other reference or references, teaches, suggests or discloses any such embodiment. Further, to the extent that any meaning or definition of a term in this document conflicts with any meaning or definition of the same term in a document incorporated by reference, the meaning or definition assigned to that term in this document shall govern.

While particular embodiments of the present disclosure have been illustrated and described, it would be obvious to those skilled in the art that various other changes and modifications may be made without departing from the spirit and scope of the present disclosure. It is therefore intended to cover in the appended claims all such changes and modifications that are within the scope of this disclosure.

What is claimed is:

1. A dispensing kit for sanitary tissue products, the dispensing kit comprising:

a dispenser defining a cavity therein, wherein the cavity is configured to receive sanitary tissue products therein, the dispenser comprising:

an opening defined therein, wherein sanitary tissue products positioned within the cavity are configured to be dispensed through the opening, wherein the opening is formed by:

a first portion having a first width;

a second portion having a second width; and a third portion having a third width and extending between the first portion and the second portion, and wherein the first width and the second width are both larger than the third width; and a hanger configured to releasably attach to the dispenser, the hanger comprising:

a first end portion comprising a generally flat base configured to engage a surface;

a second end portion comprising one or more hooks configured to engage a towel bar or a towel ring; and a body disposed intermediate the generally flat base and the one or more hooks; and wherein the first portion comprises a first engagement member and a second engagement member both extending therefrom.

2. The dispensing kit of claim 1, wherein the body comprises a first portion and a second portion, wherein the first portion extends in a first direction, and wherein the second portion extends in a second, different direction.

3. The dispensing kit of claim 2, wherein a side wall of the dispenser defines a first aperture and a second aperture therein, wherein the first engagement member is configured to engage perimeter walls of the first aperture, and wherein the second engagement member is configured to engage perimeter walls of the second aperture.

4. A hanger for a sanitary tissue product dispenser having two or more apertures defined therein, the hanger comprising:

a first end portion comprising a generally flat base configured to engage a surface;

a second end portion comprising one or more hooks configured to engage a towel bar or a towel ring; and a body disposed intermediate the base and the one or more hooks, the body comprising:

a first portion; and a second portion, wherein the first portion comprises a first engagement member and a second engagement member both extending therefrom, wherein the first engagement member is configured to engage perimeter walls of a first aperture in the dispenser, and wherein the second engagement member is configured to engage a second aperture in the dispenser such that the hanger is removably attached to the dispenser.

5. The hanger of claim 4, wherein the first portion of the body extends in a first direction, wherein the second portion of the body extends in a second, different direction, and wherein the generally flat base extends generally in the first direction.

6. The hanger of claim 5, wherein a portion of the first engagement member extends outwardly from the first portion of the body in a third direction, and wherein the second portion of the body extends generally in the third direction.

7. The hanger of claim 4, wherein the one or more hooks each comprise an arcuate portion.

* * * * *